US007019269B2

(12) United States Patent
Okuda

(10) Patent No.: US 7,019,269 B2
(45) Date of Patent: Mar. 28, 2006

(54) HEATER

(75) Inventor: Katsuhiko Okuda, Kasugai (JP)

(73) Assignee: Sanyo Netsukogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/467,249

(22) PCT Filed: Aug. 13, 2001

(86) PCT No.: PCT/JP01/07007

§ 371 (c)(1),
(2), (4) Date: Aug. 6, 2003

(87) PCT Pub. No.: WO03/017726

PCT Pub. Date: Feb. 27, 2003

(65) Prior Publication Data

US 2004/0112893 A1 Jun. 17, 2004

(51) Int. Cl.
*H05B 3/44* (2006.01)

(52) U.S. Cl. ..... 219/544; 219/541

(58) Field of Classification Search ..... 219/544, 219/553; 338/296, 302–303, 238, 242–243
See application file for complete search history.

(56) References Cited

U.S. PATENT DOCUMENTS 3,596,057 A * 7/1971 Arntz et al. ..... 338/233
5,066,852 A * 11/1991 Willbanks ..... 219/544
5,198,641 A * 3/1993 Nagano et al. ..... 219/544
5,267,609 A * 12/1993 Olsson ..... 165/133

FOREIGN PATENT DOCUMENTS

JP 53-1336 A 1/1978
JP 55-91586 A 7/1980
JP 03127482 A * 5/1991
JP 6-68965 A 3/1994

OTHER PUBLICATIONS

International Search Report for International Application PCT/JP01/07007 dated Oct. 4, 2004 (1 p.).

* cited by examiner

*Primary Examiner*—Robin O. Evans
*Assistant Examiner*—Vinod Patel
(74) *Attorney, Agent, or Firm*—Conley Rose, P.C.

(57) ABSTRACT

In a heater in which an electrically insulating material (4) including an oxide is filled between a heating element (2) made of metal including chromium and aluminum and a cover (3, 5, 6) for sealing the heating element (2), and in which a lead wire (7, 8) of the heating element (2) extends through a portion (5, 6) of an electrical insulator of the cover (3, 5, 6) in order to enable the heater to be used at temperatures higher than the prior art, an oxide film including aluminum oxide is formed on the surface of the heating element (2). The portion of the cover (3, 5, 6) excluding the portion (5, 6) serving as an electrical insulator is a metal pipe (3) that serves as a sheath and includes nickel and chromium, and an oxide film is formed on the surface of the metal pipe (3). Therefore, the heater can be used in dies for plastic forming or the like.

5 Claims, 4 Drawing Sheets

HEATER

TECHNICAL FIELD

The present invention relates to sheathed heaters, cartridge heaters, and the like and, more particularly, to techniques for enabling sheathed heaters, cartridge heaters, and the like to be used at temperatures higher than temperatures that are conventionally available.

BACKGROUND ART

Sheathed heaters and cartridge heaters have been conventionally used. These heaters include a heating element in the form of a metal wire, a cover for sealing the heating element, and an electrical insulating material constituted by an oxide, e.g., magnesium oxide, that is filled between the heating element and the cover. The cover is composed of a metal portion and an electrical insulator portion through which lead wires of the heating element extend. Joule heat is generated at the heating element by energizing the heating element via the lead wires.

Because nickel, chromium, and iron are normally used as part of the composition of the heating element and the metal portion of the cover, the heating element and the metal portion of the cover will oxidize when the heating element and the metal portion of the cover are used for a long time at temperatures as high as 850° C. or more. Because oxygen in the air disposed within the sealed heater and oxygen in the electrically insulating material is reduced as a result of the oxidization, the pressure within the sealed cover is reduced. Evaporation and dispersal of nickel, chromium, and iron components of the heating element and the metal portion of the cover is accelerated as a result of the pressure reduction.

In this event, chromium oxide forms on the surface of the heating element and the metal portion of the cover, which is made of nickel, chromium, and iron, as a result of use at high temperature, and the chromium oxide, chromium, nickel, and iron will evaporate and disperse into the electrically insulating material.

Thus, a reduction reaction of the electrically insulating material and a phenomenon known as blackening of the electrically insulating material will result, because of the dispersal of conductive chromium, chromium oxide, nickel, and iron, which evaporate and are released from the heating element and the metal portion of the cover in the electrically insulating material, thereby accelerating the deterioration of the insulation resistance of the electrically insulating material.

As a result, an extraordinarily large leakage current sometimes flows from the heating element to some locations of the metal portion of the cover via the electrically insulating material when the sheathed heater or cartridge heater is being used, and a large amount of Joule heat is locally generated at the heating element, thereby developing an extraordinarily high local temperature, which cause problems of breakage occuring in the heating element that has become thin due to release of the chromium, nickel, and iron components and the cover may melt or break.

The present invention has been conceived taking such points into consideration, and it is an object of the invention to make it possible to use heaters, such as sheathed heaters and cartridge heaters, at temperatures higher than the prior art, by suppressing deterioration of the insulation resistance of an electrically insulating material that is filled between a heating element and a cover.

DISCLOSURE OF THE INVENTION

According to the present invention, in a heater in which an electrically insulating material constituted by an oxide is filled between a heating element made of metal containing chromium and aluminum and a cover for sealing the heating element and in which a lead wire of the heating element extends through a portion serving as an electrical insulator of the cover, an oxide film including aluminum oxide is formed on the surface of the heating element, so that the surface of the heating element is electrically insulated by the aluminum oxide film, and the oxide film suppresses the generation of chromium vapors, etc., from the heating element in its heated state. This may suppress the phenomenon known as blackening of the electrically insulating material that may be caused by conductive chromium or like that evaporates and is released from the heating element and is dispersed into the electrically insulating material. In addition, the amount of oxygen that is removed from the oxide electrically insulating material between the heating element and cover by chromium vapors or the like may be suppressed. As a result, deterioration of the insulation resistance of the electrically insulating material is suppressed.

Further, the cover has good thermal conductivity because the portions of the cover other than the electrical insulator are constituted by a metal including nickel and chromium; the generation of nickel vapors and chromium vapors due to temperature increases in the metal portion of the cover is suppressed when heat is generated by the heating element, because an oxide film is formed on the surface of the metal portion of the cover. This may suppress the phenomenon known as blackening of the electrically insulating material that may be caused by conductive chromium and nickel that evaporates and is released from the metal portion of the cover and is dispersed into the electrically insulating material. In addition, the amount of oxygen that is removed from the oxide electrically insulating material filled between the heating element and the cover by nickel vapor and chromium vapor may be suppressed. As a result, deterioration of the insulation resistance of the electrically insulating material is suppressed.

Further, the electrically insulating oxide film formed on the surface of the heating element enables the heating element to be wound at a small pitch, if the heating element is formed as a spirally wound wire. As a result, if the resistance of the heating element is maintained at a predetermined value, the heating element may have a larger diameter and may accordingly have greater length, so that breakage of the heating element can be prevented.

Further, because the amount of heat generated by the heating element per unit of surface area of the same is reduced by increasing the diameter of the heating element, heat will be more easily transferred from the heating element to the cover; thus, breakage of the heating element can be suppressed, because there is a small temperature increase at the core of the heating element relative to the temperature at its surface.

In this case, both the current density through the heating element and the amount of heat generated by the heating element per unit of surface area thereof (the density of the heating load on the surface of the heating element) can be reduced to about one half of the conventionally obtained values, respectively.

Further, if the portion of the cover other than the portion comprising an electrically insulating body is a tubular portion consisting of metal including nickel and chromium serving as a sheath, it is easy to fill electrically insulating material between the heating element and the tubular metal portion sheath when the oxide film is formed on the surface of the tubular metal portion.

Furthermore, if the tubular metal portion that serves as a sheath has a cylindrical configuration, it is even easier to maintain electrical insulation between the heating element and the tubular metal portion sheath by filling an electrically insulating material between the heating element and the cylindrical metal portion.

BEST MODE FOR PRACTICING THE INVENTION

An embodiment of the present invention will now be described with reference to the drawings.

Figure 1:
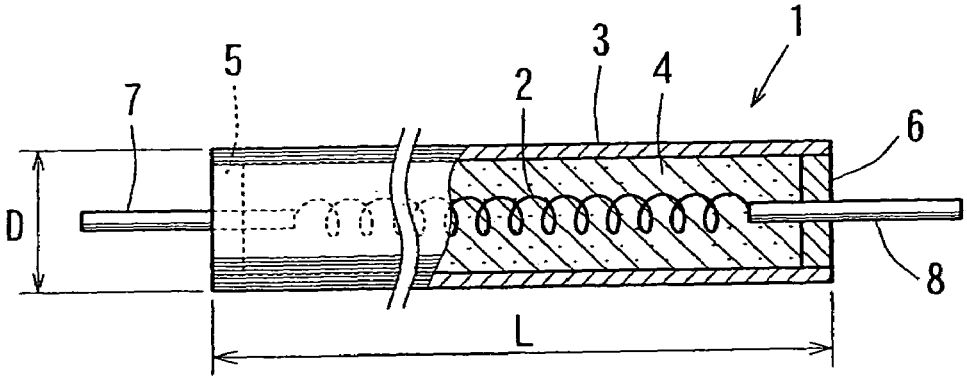
FIG. 1 is a partially cut-away front view of a sheathed heater according to a first embodiment of the present invention.
Figure 2:
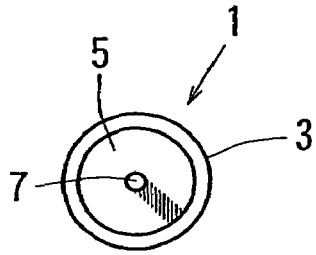
FIG. 2 is a left side view of the heater shown in FIG. 1.

FIG. 1 is a partially cut-away front view of a sheathed heater according to a first embodiment of the invention, and FIG. 2 shows a left side view of the heater shown in FIG. 1.

In FIG. 1, a sheathed heater 1 includes a heating element 2 made of metal containing chromium and aluminum in the form of a wire having a spiral-shaped configuration; pipe 3 is made of metal containing nickel and chromium and serves as a sheath for covering the heating element 2; an electrically insulating material 4 for electrical insulating is disposed between the heating element 2 and the pipe 3; a first lead wire 7 is connected to the left end of the heating element 2 as viewed in the figure; a second lead wire 8 is connected to the right end of the heating element 2 as viewed in the figure; a first lead glass 5 seals the left end of the pipe 3 as viewed in the figure; and a second lead glass 6 seals the right end of the pipe 3 as viewed in the figure. The pipe 3 and the first and second lead glass portions 5 and 6 together form a cover.

The first lead wire 7 extends through the first lead glass 5, and the second lead wire 8 extends through the second lead glass 6. An oxide film made of aluminum oxide having electrically insulating properties is formed on the surface of the heating element 2, and an oxide film made of chromium oxide, or the like is formed on the surface of the pipe 3. For example, the sheathed heater 1 has a diameter D of 6.5 mm ϕ, and the sheathed heater 1 has a length L of about 1000 mm.

As shown in FIG. 2, the pipe 3 has a cylindrical configuration.

A method for manufacturing the sheathed heater 1 according to the first embodiment is as follows.

First, a pipe 3 made of metal and serving as a sheath is prepared. The material of the pipe 3 is e.g., Incoloy 800 (Tradename). Incoloy 800 is an alloy that contains in total 30 to 35% of nickel and cobalt, 19 to 23% of chromium, 39.5% or more of iron, 0.1% or less of carbon, 1.5% or less of manganese, 0.015% or less of sulfur, 1.0% or less of silicon, 0.75% or less of copper, 0.15 to 0.6% of aluminum, and 0.15 to 0.6% of titanium, each amount being in terms of percentage by weight. With regard to the dimensions of the pipe 3, for example, the outer diameter may be 7.5 mmϕ and the length may be 1000 mm.

The pipe 3 is heated within an electric oven at 1100° C. for 1.5 hours to form an oxide film on the surface of the pipe 3. The oxide film formed on the surface of the pipe 3 may include chromium oxide.

Next, the heating element 2 is prepared in the form of a wire. For example, the heating element 2 may be made of an iron-chromium-aluminum alloy. Specifically, the material of the heating element 2 may be, e.g., NTK No. 30 (Tradename) according to JISFCH-1. NTK No. 30 is an alloy which contains 23 to 26% of chromium, 4 to 6% of aluminum, 0.10% or less of carbon, 1.5% or less of silicon, and 1.0% or less of manganese in terms of percentage by weight, the rest being iron. For example, the heating element 2 has a diameter of 0.8 mmϕ and a length of 6400 mm.

The heating element 2 is wound into a coil using, for example, a core of 1.2 mmϕ and is washed and dried; thereafter, the heating element 2 is heated in an electric oven at 1100° C. for 3 hours to form an oxide film on the surface of the heating element 2. Because the oxide film material is aluminum oxide, the oxide film is an electrical insulator. This makes it possible to wind the wire-shaped heating element 2 into a coil with a winding pitch smaller than those in the prior art, so that an increased length of the heating element 2 can be wound within a predetermined range, and the diameter of the heating element 2 can be increased. The resistance of the heating element 2 is proportionate to the length of the same and inversely proportionate to the cross-sectional area of the same. It is therefore possible to suppress breakage of the heating element 2 that can be wound in a predetermined area and that has a predetermined resistance.

Next, the heating element 2 having the oxide film formed thereon is inserted into the pipe 3 having the oxide film, and magnesia powder as an electrically insulating material is filled into the gap between the pipe 3 and the heating element 2. Thereafter, the pipe 3 is rolled at room temperature using a press or the like in order to reduce the diameter of the pipe 3 to a diameter D of 6.5 mmϕ, thereby obtaining an incomplete sheathed heater 1. Because the density of the electrically insulating material 4 can be increased by rolling the pipe 3 to reduce the diameter as described above, the thermal conductivity of the electrically insulating material 4 can be improved. This makes it possible to prevent abnormal temperature increases of the heating element 2 with respect to the temperature of the pipe 3 and consequently, makes it possible to suppress breakage of the heating element 2 due to temperature increases of the heating element 2.

The incomplete sheathed heater 1 is heated for 4 hours in the atmosphere at 850° C. in order to reduce moisture in the electrically insulating material 4; both ends of the pipe 3 are thereafter completely sealed with the first and second lead glasses 5 and 6; the first and second lead wires 7 and 8 respectively penetrate through the first lead glass 5 and the second lead glass 6. The sheathed heater 1 is therefore sealed with the pipe 3 serving as a cover and the first and second lead glasses 5 and 6. The sheathed heater 1 having a length L of 1000 mm was experimentally fabricated in this way.

A voltage was applied across the first lead wire 7 and the second lead wire 8 in order to energize the heating element 2 and in order to cause the heating element 2 to generate heat; insulation resistance between the first lead wire 7 (or the second lead wire 8) and the pipe 3 was measured after the surface temperature of the pipe 3 increased to 950° C. and sufficiently stabilized at that temperature (about one hour later).

Next, energization of the heating element 2 was stopped and, after the surface temperature of the pipe 3 returned to room temperature, the withstand voltage between the first lead wire 7 (or the second lead wire 8) and the pipe 3 was measured. Such measurements were also performed on a conventional product (a sheath heater fabricated using a pipe and a heating element in the form of a wire having no oxide film thereon), and Table 1 is shown below for comparison. The term "embodiment" in Table 1 and Table 2, which will be described below means the sheathed heater 1 embodying the invention.

TABLE 1

| | Insulation resistance (MΩ) of pipe 3 at surface temp. of 950° C. | Withstand voltage (V) at room temperature |
|---|---|---|
| Embodiment | 3.5 | 3500 |
| Conventional product | 0.5 | 2700 |

Table 2 shows measurements of insulation resistance similarly obtained at different surface temperatures of the pipe 3.

TABLE 2

| Pipe 3 surface temp. (° C.) | Embodiment (MΩ) | Conventional product (MΩ) |
|---|---|---|
| 950 | 3.5 | 0.5 |
| 975 | 2.5 | Heating element broke |
| 1000 | 1.7 | |
| 1050 | 0.8 | |
| 1100 | 0.6 | |

Because deterioration of the insulation provided by the electrically insulating material 4 is suppressed by the oxide films on the surface of the pipe 3 and heating element 2, which are formed in advance in the atmosphere as described above, the sheathed heater 1 can be used in a very high temperature range (900 to 1100° C.), and the life of the sheathed heater 1 can be significantly extended. Effects similar to those shown in the above-described Tables 1 and 2 were achieved by a cartridge heater 11 that will be described below.

Figure 3:
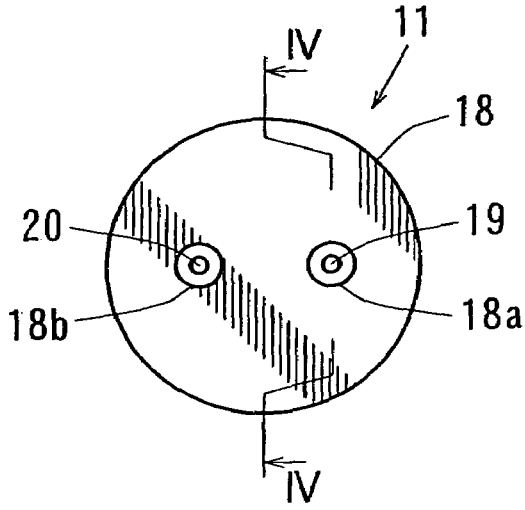
FIG. 3 is an enlarged side view on the side of lead wires of a cartridge heater according to a second embodiment of the present invention.
Figure 4:
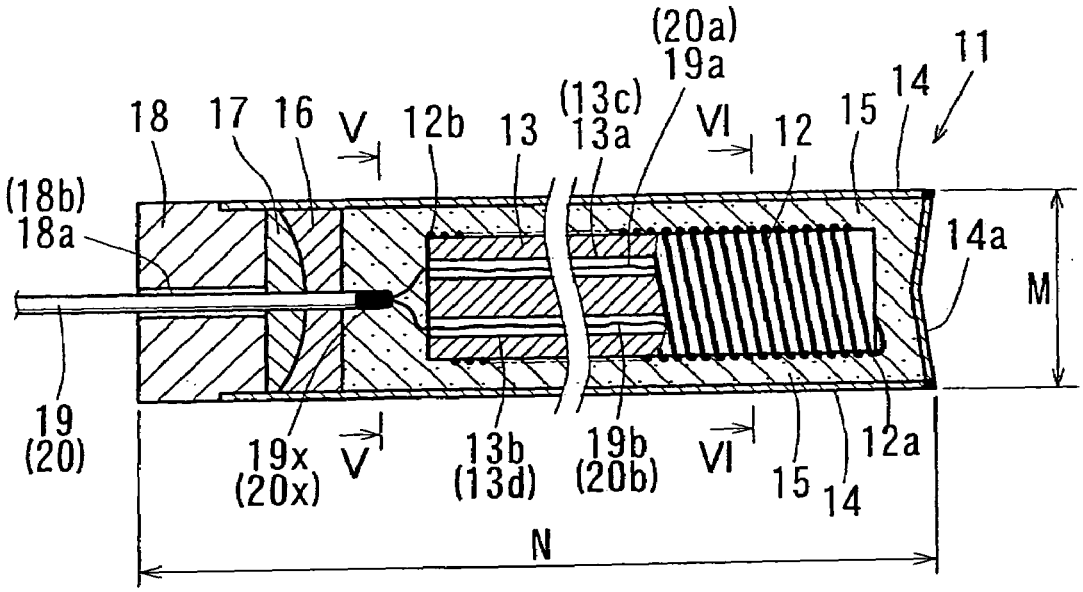
FIG. 4 is a slightly reduced cross sectional view of the structure taken along line IV—IV in FIG. 3.
Figure 5:
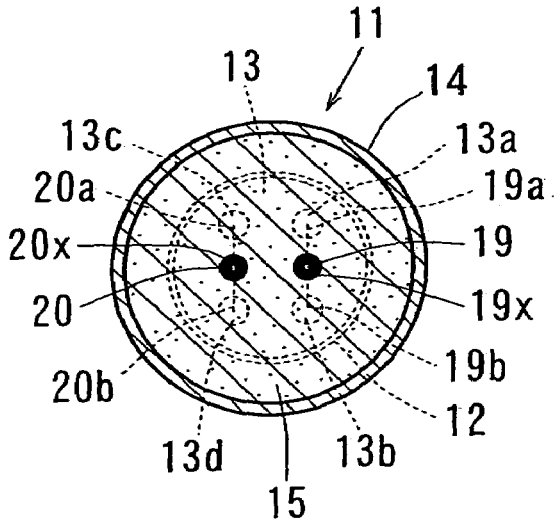
FIG. 5 is an enlarged view showing the structure of a cross-section taken along line V—V in FIG. 4.
Figure 6:
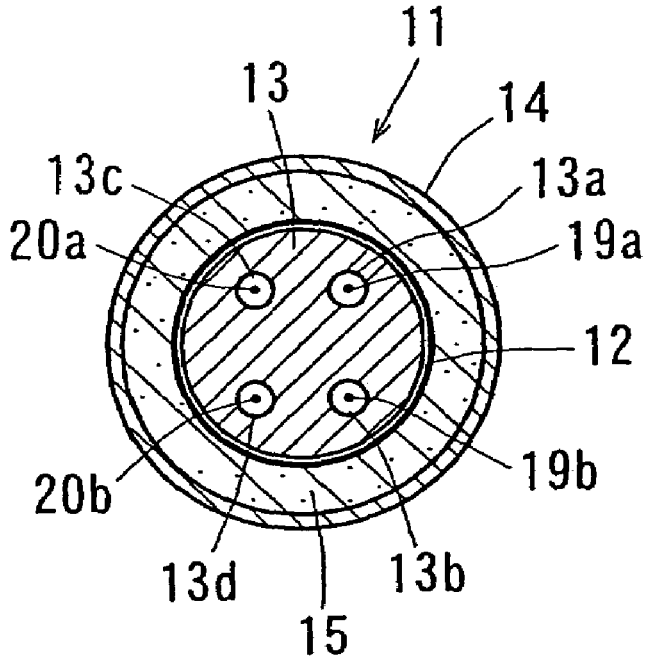
FIG. 6 is an enlarged view showing the structure of a cross-section taken along line VI—VI in FIG. 4.

FIG. 3 is an enlarged view on the side of lead wires of a cartridge heater according to a second embodiment of the present invention; FIG. 4 is a slightly reduced cross-sectional view of the structure taken along line IV—IV in FIG. 3; FIG. 5 is an enlarged cross-sectional view of the structure taken along line V—V in FIG. 4; and FIG. 6 is an enlarged cross-sectional view of the structure taken along line VI—VI in FIG. 4.

As shown in FIG. 3, in a cartridge heater 11, a first lead wire 19 extends through a through hole 18*a* of an entrance insulator 18, and a second lead wire 20 extends through a through hole 18*b* of the entrance insulator 18. The first lead wire 19 and second lead wire 20 are rod-shaped members made of metal and serve as lead wires for a heating element 12 that will be described below.

As shown in FIG. 4, the cartridge heater 11 is formed by filling a pipe 14 made of metal and serving as a sheath (with a welded bottom plate 14*a*) with an electrically insulating material 15; a coil-shaped heating element 12 is spirally wound around a ceramic core 13 and includes the first and second lead wires 19 and 20 (see FIG. 3) connected thereto and is inserted into the pipe 14; at the exit portions of the lead wires 19 and 20 the pipe 14 is sealed with lead glass 16.

While FIG. 4 shows a cross section of the region through which the first lead wire 19 in FIG. 3 extends, reference numerals to be used for a cross section of the region through which the second lead wire 20 extends are indicated in brackets in FIG. 4.

As shown in FIG. 6, four through holes 13*a*, 13*b*, 13*c*, and 13*d* are formed so as to extend in parallel within the ceramic core 13. A twisted wire 19*a* is inserted through the through hole 13*a*, and a twisted wire 19*b* is inserted through the through hole 13*b*. A twisted wire 20*a* is inserted through the through hole 13*c*, and a twisted wire 20*b* is inserted through the through hole 13*d*. The twisted wires 19*a*, 19*b*, 20*a*, and 20*b* are electrically conductive wires for electrical connection.

As shown in FIG. 4, the left ends of the twisted wires 19*a* and 19*b* are welded to the right end 19*x* of the first lead wire 19, and left ends of the twisted wires 20*a* and 20*b* are welded to the right end 20*x* of the second lead wire 20 (see FIG. 5).

The right end of the twisted wire 19*a* is connected to the right end of the twisted wire 19*b* at the right side of the through holes 13*a* and 13*b* and the right ends are also connected to a right end 12*a* of the heating element 12.

The twisted wires 20*a* and 20*b* are connected to each other at the right side of the through holes 13*c* and 13*d* and are further connected to a left end 12*b* of the heating element 12 on the left side of the through holes 13*c* and 13*d*.

The bottom plate 14*a* is made of the same material as the pipe 14 and is welded to the pipe 14 such that it covers the right end of the pipe 14. The left end of the pipe 14 is sealed with the lead glass 16, and the entrance insulator 18 is secured to the lead glass 16 and the pipe 14 by a ceramic adhesive 17.

A method for manufacturing the cartridge heater 11 according to the second embodiment will be described as follows.

First, the pipe 14 is prepared. For example, the pipe 14 is made of Incoloy 800 and is 12 mmϕ in outer diameter and 120 mm in length. The bottom plate 14*a* made of the same material as the pipe 14 is welded to the right end of the pipe 14, and a heating process is performed in an electric oven at 1100° C. for 1.5 hours to form oxide films on the surfaces of the pipe 14 and the bottom plate 14*a*.

Next, the heating element 12 is prepared. Specifically, the material of the heating element 12 is, e.g., Kanthal AF wire (Trade name). The Kanthal AF wire is an alloy that includes 22% of chromium and 5.3% of aluminum in terms of percentage by weight, the rest of the material being iron.

The heating element 12 in the form of a wire (having an outer diameter of 0.3 mmϕ) is wound around the outer circumference of a ceramic core (having a diameter of 5 or 6 mmϕ and a length of 60 mm, for example) at a pitch of 0.4 mm and is then washed and dried, and thereafter is heated in an electric oven at 1150° C. for 3 hours to form an oxide film on the heating element 12. In this case, the oxide film is an electrical insulator, because it is made of aluminum oxide. The first and second lead wires 19 and 20 are then connected to the heating element 12 using the above-described twisted wires 19*a*, 19*b*, 20*a* and 20*b*.

Next, the ceramic core 13 around which the heating element 12 is wound is inserted into the center of the pipe 14; magnesia serves as an electrically insulating material 15 and is filled into the gap between the ceramic core 13 with the heating element 12 and the pipe 14; the diameter of the pipe 14 is thereafter reduced to 10.2 mmϕ by using a press; and the pipe 14 is polished to 10+0 to 10−0.05 mmϕ by a polishing machine.

Next, a drying process is performed in an electric oven at 850° C. for 4 hours in order to reduce moisture in the electrically insulating material 15, and the exit of the pipe 14 for the first and second lead wires 19 and 20 is sealed with the lead glass 16. Thereafter, the entrance insulator 18 is secured to the left side, as viewed in the figure, of the lead glass 16 by the ceramic adhesive 17 (see FIG. 4). The entrance insulator 18 is formed with the through holes 18*a* and 18*b*, so the first lead wire 19 extends through the through hole 18*a*, and the second lead wire 20 extends through the through hole 18*b* (see FIG. 3).

The cartridge heater 11 (which had a diameter M of 10 mm and a length N of 120 mm and which was rated at 120 volts and 400 watts, for example) was thus fabricated.

Figure 7:
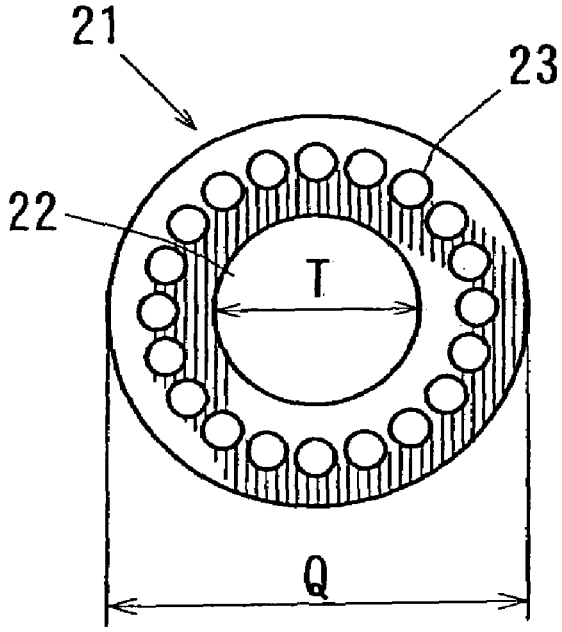
FIG. 7 is a reduced front view of a die utilizing a cartridge heater.
Figure 8:
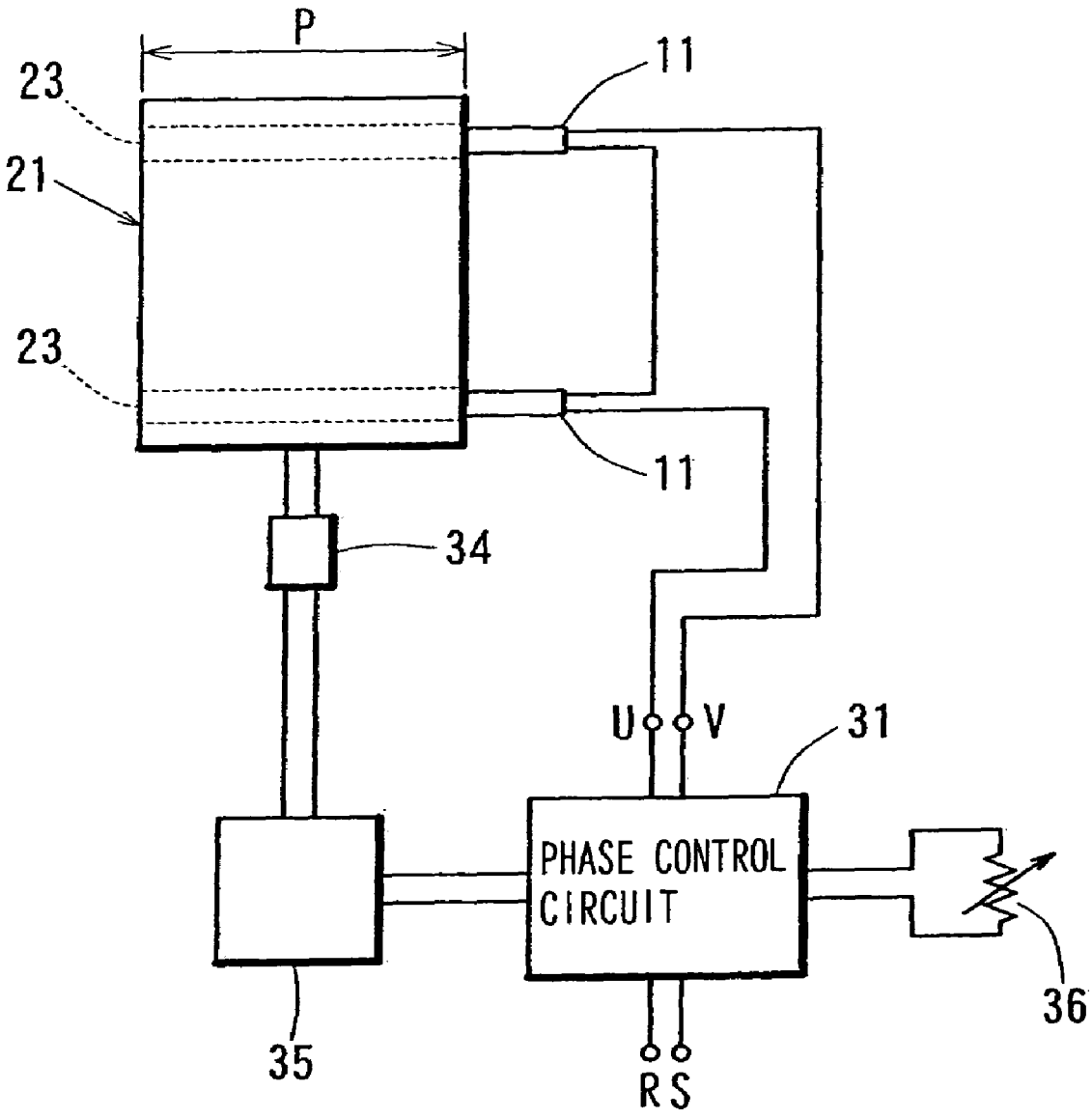
FIG. 8 is an explanatory view showing a method for measuring the characteristics of a cartridge heater.

FIG. 7 is a reduced view of a molding die that utilizes cartridge heaters 11, and FIG. 8 illustrates a method for measuring the characteristics of the cartridge heaters 11.

With respect to the dimensions of die 21 in FIG. 7 and FIG. 8, the die 21 has an inner diameter T (the diameter of a through hole 22 in the center of the die 21) of 50 mmϕ, an outer diameter Q of 110 mmϕ (see FIG. 7), and a length P of 90 mm (see FIG. 8). As shown in FIG. 7, twenty through holes 23 having a bore size of 10.1 mmϕ are formed on the circumference of a circle of 80 mmϕ in the die 21 (the circumference of a circle concentric with the through hole 22).

One cartridge heater 11 is inserted into each of the through holes 23. Ten sets of cartridge heaters 11 are each connected between output terminals U and V of a phase control circuit 31 in parallel with each other, one set being formed by two cartridge heaters 11 in which one is rated at 120 volts and the other is rated at 400 watts with the two connected in series. FIG. 8 shows only one set of cartridges 11 for convenience.

The phase control circuit 31 controls the phase of an input AC voltage (having an effective value of 200 volts) applied between an input terminals R and S to output an output voltage (effective value) lower than the input AC voltage at the output terminals U and V. A variable resistor 36 adjusts the magnitude of the output voltage and, in this case, the output voltage (effective value) is set to be 70% of the input AC voltage (effective value).

A temperature sensor 34 measures the temperature of the die 21 and, for example, it may be a thermocouple. For example, the set temperature for a temperature controller 35 is 1000° C. The temperature controller 35 calculates the difference between the set temperature and the temperature of the die 21 measured by the temperature sensor 34 and performs PID control of the phase control circuit 31 such that the temperature difference becomes zero. In this case, PID control means a combination of a proportional control (P), an integration control (I), and a differential control (D) and is performed such that the temperature difference becomes zero.

The temperature of the die 21 stabilized at 1000° C. about 45 minutes after the cartridge heaters 11 were energized. No abnormality, such as breakage of the heating element 12, was observed even after a durability test was continuously performed for 720 hours in this state.

In this case, if the voltage applied to each cartridge heater 11 is 70 volts, each cartridge heater 11 carries a current of 1.94 amperes and consumes 136 watts of power. Therefore, the power consumption of the twenty cartridge heaters 11 is about 2.7 kilowatts.

While the metal portion of the cover serving as a sheath has a circular cross section in the above-described embodiment, the present invention is not limited to this embodiment, and the cross section of the metal portion of the cover serving as a sheath may have a polygonal configuration, such as a hexagon and an octagon, or an elliptical configuration. While one heater is provided in the metal portion to serve as a sheath in the above-described embodiment, the present invention is not limited to this embodiment, and a plurality of heating elements may be provided in parallel in the metal portion to serve as a sheath.

INDUSTRIAL APPLICABILITY

Because a heater according to the present invention can be used at 1100° C., which is higher than temperatures possible in the prior art that was described above, the heater can be used to achieve temperatures higher than those in the prior art, and the invention is advantageous in extending the life of a heater.

It is therefore possible to use a heater according to the present invention in dies for plastic forming, processes for manufacturing semiconductor wafers, processes for hot sizing, e.g., for forming titanium plates, processes for molding plastics, electric ovens for quenching and tempering metals, baking ovens for thermally treating glass plates of liquid crystal panels, microwave ovens having heaters, copying machines, and so on.

The invention claimed is:

1. A heater in which an electrically insulating material comprising an oxide is tilled between a heating element comprising a metal including chromium and aluminum and a cover for sealing the heating element, and in which a lead wire of said heating element extends through a first portion of said cover, said first portion serving as an electrical insulator of said cover and together with said cover establishing a sealed environment for said heating element through an operating range of said heater, wherein an oxide film comprising aluminum oxide is formed on the surface of said heating element and wherein a portion of said cover excluding said first portion is a metal portion including nickel and chromium and an oxide film comprising chromium oxide is formed on the surface of the metal portion.

2. A heater according to claim 1, characterized in that said heating element is in the form a spirally wound wire.

3. A heater in which an electrically insulating material comprising an oxide is filled between a heating element comprising a metal including chromium and aluminum and a cover for sealing the heating element, and in which a lead wire of said heating element extends through a first portion of said cover, said first portion serving as an electrical insulator of said cover, said heater made by the steps:

a) providing a metal pipe comprising nickel, cobalt, chromium, and iron;

b) heating said pipe so as to form an oxide film on the surface of said pipe;

c) providing a heating element comprising an iron-chromium-aluminum alloy;

d) winding said heating element into a coil;

e) heating said coil so as to form an aluminum oxide film on the surface of said heating element;

f) inserting said coil into said pipe;

g) rolling said pipe containing said coil so as to reduce the diameter of said pipe to less than 6.5 mmφ, thereby obtaining an incomplete sheathed heater; and h) sealing both ends of said pipe with first and second lead glasses, with first and second lead wires penetrating at least one of said first and second lead glasses, wherein said pipe and said first and second lead glasses form a cover that seals said heating element and wherein an oxide film comprising chromium oxide is formed on a surface of the metal portion of said cover.

4. The heater according to claim 3 wherein the steps for forming the heater further include:

heating the incomplete sheathed heater of step g) so as to reduce moisture therein prior to step h).

5. The heater according to claim 3 wherein magnesia powder is emplaced in the gap between said pipe and said coil.

* * * * *